US008531382B2

(12) United States Patent
Hamada

(10) Patent No.: US 8,531,382 B2
(45) Date of Patent: Sep. 10, 2013

(54) WHITE LED BACKLIGHT DEVICE WITH COLOR COMPENSATION AND DISPLAY DEVICE USING THE SAME

(75) Inventor: Tetsuya Hamada, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 687 days.

(21) Appl. No.: 12/514,708

(22) PCT Filed: Jun. 12, 2007

(86) PCT No.: PCT/JP2007/061832

§ 371 (c)(1),
(2), (4) Date: May 13, 2009

(87) PCT Pub. No.: WO2008/065765

PCT Pub. Date: Jun. 5, 2008

(65) Prior Publication Data

US 2010/0053064 A1 Mar. 4, 2010

(30) Foreign Application Priority Data

Nov. 29, 2006 (JP) ..... 2006-321173

(51) Int. Cl.
*G09G 3/36* (2006.01)

(52) U.S. Cl.
USPC ..... 345/102

(58) Field of Classification Search
USPC ..... 345/102
See application file for complete search history.

(56) References Cited

U.S. PATENT DOCUMENTS

| | | | | |
|---|---|---|---|---|
| 7,333,165 | B2 * | 2/2008 | Nakano et al. | 349/68 |
| 2002/0175632 | A1 | 11/2002 | Takeguchi | |
| 2005/0200295 | A1 * | 9/2005 | Lim et al. | 315/150 |
| 2005/0259439 | A1 | 11/2005 | Cull et al. | |
| 2006/0066266 | A1 * | 3/2006 | Lim et al. | 315/291 |
| 2006/0152468 | A1 * | 7/2006 | Ozaki | 345/102 |
| 2007/0024571 | A1 * | 2/2007 | Maniam et al. | 345/102 |
| 2007/0146916 | A1 * | 6/2007 | Yang et al. | 359/891 |

FOREIGN PATENT DOCUMENTS

| | | | |
|---|---|---|---|
| JP | 2003-58125 A | | 2/2003 |
| JP | 2003058125 A | * | 2/2003 |
| JP | 2004-21147 A | | 1/2004 |
| JP | 2004342454 A | * | 12/2004 |
| JP | 2005-184020 A | | 7/2005 |
| JP | 2006-30898 A | | 2/2006 |

OTHER PUBLICATIONS

International Search Report issued Oct. 15, 2010, in corresponding EP 077451193.

* cited by examiner

*Primary Examiner* — Kwang-Su Yang
(74) *Attorney, Agent, or Firm* — Birch, Stewart, Kolasch & Birch, LLP

(57) ABSTRACT

A backlight device (2) for emitting illumination light outward includes white light-emitting diodes (4*w*) for emitting white light, and red and blue light-emitting diodes (4*r*, 4*b*) for emitting red light and blue light, respectively. The backlight device (2) further includes a lighting drive circuit (lighting control portion) (11) for controlling the lighting/driving of each of the light-emitting diodes (4*w*, 4*r*, 4*b*).

12 Claims, 4 Drawing Sheets

WHITE LED BACKLIGHT DEVICE WITH COLOR COMPENSATION AND DISPLAY DEVICE USING THE SAME

TECHNICAL FIELD

The present invention relates to a backlight device, particularly a backlight device including a light-emitting diode as a light source, and a display device using the same.

BACKGROUND ART

In recent years, e.g., a liquid crystal display device has been widely used for a liquid crystal television, a monitor, a portable telephone, etc. as a flat panel display having features such as a smaller thickness and a lighter weight compared to a conventional cathode ray tube. Such a liquid crystal display device includes a backlight device and a liquid crystal panel. The backlight device emits light and the liquid crystal panel displays a desired image by serving as a shutter with respect to light from a light source provided in the backlight device.

The backlight device has been provided as a sidelight type or a direct type in which a linear light source composed of a cold-cathode tube or a hot-cathode tube is located on the side or underside of the liquid crystal panel. However, the cold-cathode tube etc. contain mercury and have not been easily recyclable when they are discarded. Therefore, some conventional backlight devices use a mercury-free light-emitting diode (LED) as a light source (see, e.g., JP 2004-21147 A).

In the backlight device of the above first conventional example, three types of light-emitting diodes for emitting three colors (red (R), green (G), and blue (B)) of light are provided, and the light rays from the three types of light-emitting diodes are mixed into white light, which then is directed to the liquid crystal panel as illumination light.

In another conventional backlight device, white light-emitting diodes are provided in addition to the three types of R, G, and B light-emitting diodes (see, e.g., JP 2002-350846 A). This backlight device of the second conventional example is considered to be able to emit a neutral color of illumination light without reducing the brightness.

DISCLOSURE OF INVENTION

Problem to be Solved by the Invention

However, when the number of light-emitting diodes placed in the above conventional backlight devices is to be reduced, proper control of the brightness and chromaticity of the illumination light becomes difficult.

Specifically, the backlight device of the first conventional example emits illumination light by using the three types of R, G, and B light-emitting diodes. However, each of the light-emitting diodes has low luminous efficiency. Therefore, many light-emitting diodes need to be placed so as to control the brightness and chromaticity of the illumination light to desired values. The backlight device of the second conventional example uses the white light-emitting diodes in addition to the three types of light-emitting diodes. However, the white light-emitting diodes generally produce white light by providing the light-emitting portions of the blue light-emitting diodes with a yellow phosphor or green and red phosphors. Consequently, as in the case of the first conventional example, the second conventional example also requires many light-emitting diodes to control the brightness and chromaticity of the illumination light to desired values. Accordingly, when the number of light-emitting diodes placed in the conventional backlight devices is to be reduced, it is difficult to prevent a decrease in brightness of the illumination light and/or to properly adjust the chromaticity of the illumination light. Thus, the cost and power consumption of the conventional backlight devices cannot be easily reduced.

With the foregoing in mind, it is an object of the present invention to provide a low-cost low-power backlight device that can properly control the brightness and chromaticity of illumination light even if the number of light-emitting diodes placed is to be reduced, and a display device using the same.

Means for Solving Problem

In order to achieve the above object, a backlight device of the present invention emits illumination light outward and includes the following: white light-emitting diodes for emitting white light; two types of light-emitting diodes selected from three types of red, green, and blue light-emitting diodes for emitting red light, green light, and blue light, respectively; and a lighting control portion for controlling the lighting/driving of each of the white light-emitting diodes and the two types of light-emitting diodes.

In the backlight device with the above configuration, the white light-emitting diodes and the two types of light-emitting diodes selected from three types of red, green, and blue light-emitting diodes are provided. Moreover, the lighting control portion for controlling the lighting/driving of each of the white light-emitting diodes and the two types of light-emitting diodes is provided. Unlike the conventional examples, this configuration makes it possible to properly control the brightness and chromaticity of the illumination light even when the number of light-emitting diodes placed is to be reduced. Therefore, a low-cost low-power backlight device can be achieved.

In the backlight device, the lighting control portion may adjust the chromaticity of the illumination light to a value within a predetermined range of the degree of whiteness by controlling the amount of light of each of the white light-emitting diodes and the two types of light-emitting diodes.

In this case, the backlight device can control the degree of whiteness of the illumination light with high precision.

In the backlight device, it is preferable that light-emitting diodes that emit white light that is within a tolerance of the degree of whiteness are selected as the white light-emitting diodes, and the tolerance of the degree of whiteness is determined using the chromaticity of light from each of the two types of light-emitting diodes and the predetermined range of the degree of whiteness.

In this case, since suitable light-emitting diodes are selected as the white light-emitting diodes that have relatively large variations in their emission performance, the degree of whiteness of the illumination light can be more easily controlled.

In the backlight device, it is preferable that the two types of light-emitting diodes are the red light-emitting diodes and the blue light-emitting diodes.

In this case, compared to the use of the green light-emitting diodes, the degree of whiteness of the illumination light can be easily controlled.

In the backlight device, light-emitting diodes having a dominant wavelength of 580 nm to 640 nm may be used as the red light-emitting diodes.

In this case, the red light-emitting diodes include the light-emitting diodes for emitting orange luminous color, and therefore the degree of freedom in the design of the backlight device can be increased.

The backlight device may further include a light guide plate with an incident surface through which light from the white light-emitting diodes and the two types of light-emitting diodes is introduced. The white light-emitting diodes and the two types of light-emitting diodes may be alternately arranged to face the incident surface.

This configuration results in a sidelight type backlight device that can properly control the brightness and chromaticity of the illumination light even if the number of light-emitting diodes placed is to be reduced.

The backlight device may further include a light guide plate with an incident surface through which light from the white light-emitting diodes and the two types of light-emitting diodes is introduced. Two opposing surfaces of four surfaces of the light guide plate may serve as incident surfaces through which light from the white light-emitting diodes and one of the two types of light-emitting diodes is introduced, and the remaining two opposing surfaces may serve as incident surfaces through which light from the white light-emitting diodes and the other of the two types of light-emitting diodes is introduced.

This configuration results in a high-intensity sidelight type backlight device.

In the backlight device, the light-emitting portions of the white light-emitting diodes and the two types of light-emitting diodes may be located on a straight line with respect to an object to be irradiated.

This configuration results in a direct type backlight device that can properly control the brightness and chromaticity of the illumination light even if the number of light-emitting diodes placed is to be reduced.

In the backlight device, it is preferable that the lighting control portion includes a driving circuit portion that lights and drives the white light-emitting diodes and the two types of light-emitting diodes by PWM dimming.

In this case, since the driving circuit portion controls the amount of light of each of the white light-emitting diodes and the two types of light-emitting diodes by PWM dimming, even if the amount of light of each of the light-emitting diodes is changed, it can be suitably changed without molding the spectrum of light from the corresponding light-emitting diodes.

It is preferable that the backlight device further includes a color sensor for detecting the illumination light, and that the lighting control portion controls the amount of light of each of the white light-emitting diodes and the two types of light-emitting diodes using the detection results of the color sensor.

In this case, since the lighting control portion controls the amount of light of each of the white light-emitting diodes and the two types of light-emitting diodes by feedback control using the detection results of the color sensor, the brightness and chromaticity of the illumination light can be more properly controlled.

A display device of the present invention includes a display portion, and the display portion is irradiated with illumination light from any of the above backlight devices.

In the display device with the above configuration, the display portion is irradiated with illumination light from the backlight device that can properly control the brightness and chromaticity of the illumination light even if the number of light-emitting diodes placed is to be reduced. Therefore, a low-cost low-power display device with excellent display performance can be easily achieved even if the brightness and screen size of the display portion are to be increased.

Effects of the Invention

The present invention can provide a low-cost low-power backlight device that can properly control the brightness and chromaticity of illumination light even if the number of light-emitting diodes placed is to be reduced, and a display device using the same.

DESCRIPTION OF THE INVENTION

Hereinafter, preferred embodiments of a backlight device and a display device including the backlight device of the present invention will be described with reference to the drawings. The following description gives an example of applying the present invention to a transmission type liquid crystal display device.

Embodiment 1

Figure 1:
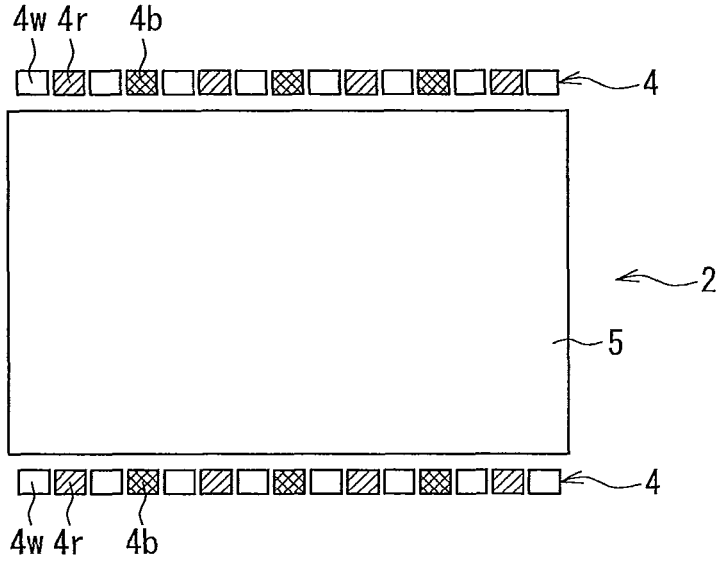
FIG. 1 is a plan view showing the configuration of a main portion of a backlight device according to Embodiment 1 of the present invention.
Figure 2:
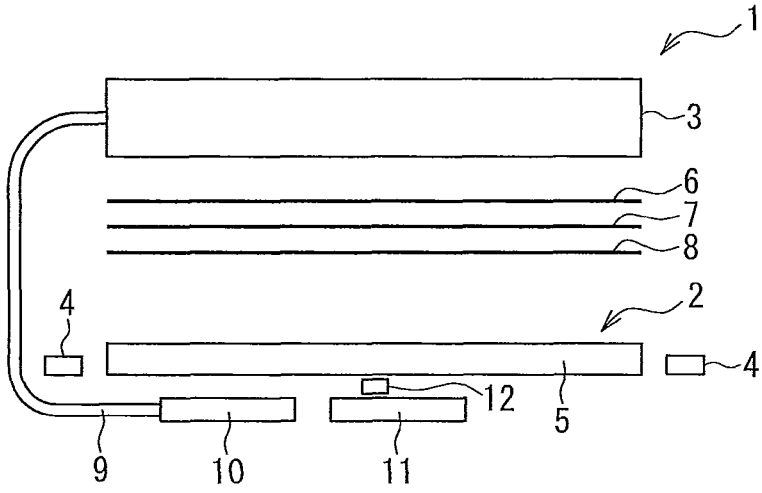
FIG. 2 is a diagram for explaining a liquid crystal display device including the backlight device shown in FIG. 1.

FIG. 1 is a plan view showing the configuration of a main portion of a backlight device according to Embodiment 1 of the present invention. FIG. 2 is a diagram for explaining a liquid crystal display device including the backlight device shown in FIG. 1. In FIGS. 1 and 2, this embodiment includes a backlight device 2 of the present invention and a liquid crystal panel 3 that serves as a display portion to be irradiated with light from the backlight device 2. The backlight device 2 and the liquid crystal panel 3 are integrated as a transmission type liquid crystal display device 1.

The backlight device 2 includes a plurality of light-emitting diodes 4 serving as a light source and a light guide plate 5 into which light from each of the plurality of light-emitting diodes 4 is introduced, and directs planar illumination light from the light guide plate 5 to the liquid crystal panel 3. The backlight device 2 is configured so that the chromaticity of the illumination light is adjustable to a value within a predetermined range of the degree of whiteness.

In the backlight device 2, as shown in FIG. 1, the plurality of light-emitting diodes 4 are placed in either upper or lower arrangement region of the light-emitting diodes 4. The upper region and the lower region are located on the upper side and the lower side of the light guide plate 5 in FIG. 1, respectively. These upper and lower regions are incorporated into the liquid crystal display device 1 so as to face the upper and lower portions of a display surface (not shown) of the liquid crystal panel 3 in the lateral direction, respectively. Moreover, these upper and lower regions are located on the upper and lower sides in the vertical direction in which the gravity acts during the operation of the liquid crystal display device 1, respectively.

The plurality of light-emitting diodes 4 include white, red, and blue light-emitting diodes 4*w*, 4*r*, and 4*b* (represented by non-hatching, hatching, and cross-hatching in FIG. 1) for emitting white (W) light, red (R) light, and blue (B) light, respectively. As the white light-emitting diodes 4*w*, light-emitting diodes that fall within a tolerance of the degree of whiteness are selected, as will be described in detail later. Thus, the chromaticity of the illumination light, particularly the degree of whiteness can be more easily controlled.

In the liquid crystal display device 1, e.g., a polarizing sheet 6, a prism (condensing) sheet 7, and a diffusing sheet 8 are disposed between the liquid crystal panel 3 and the light guide plate 5. These optical sheets appropriately increase the brightness of the illumination light from the backlight device 2, and thus can improve the display performance of the liquid crystal panel 3.

In the liquid crystal display device 1, a liquid crystal layer (not shown) included in the liquid crystal panel 3 is connected to a drive control circuit 10 via an FPC (flexible printed circuit) 9. The drive control circuit 10 is configured so as to be capable of driving the liquid crystal layer pixel by pixel.

Moreover, a lighting drive circuit 11 serving as a lighting control portion for controlling the lighting/driving of each of the light-emitting diodes 4*w*, 4*r*, and 4*b* is provided in the vicinity of the drive control circuit 10. The lighting drive circuit 11 is configured so as to light and drive the light-emitting diodes 4*w*, 4*r*, and 4*b* by PWM dimming. The lighting dive circuit 11 also controls the amount of light of each of the light-emitting diodes 4*w*, 4*r*, and 4*b* using the detection results of a color sensor 12 that is located opposite to the center of the non-emission surface of the light guide plate 5 (i.e., the side of the light guide plate 5 that faces away from the liquid crystal panel 3). This will be described in detail later.

The light guide plate 5 is made of a synthetic resin such as a transparent acrylic resin. As shown in FIG. 2, the light guide plate 5 has a rectangular cross section, and the upper and lower surfaces of the light guide plate 5 in FIG. 1 function as incident surfaces. In other words, light from each of the plurality of light-emitting diodes 4 placed in the upper and lower regions is introduced onto the upper and lower surfaces of the light guide plate 5, respectively. Then, the illumination light is emitted from the emission surface of the light guide plate 5 that faces the diffusion sheet 8 to the liquid crystal panel 3.

Specifically, the light-emitting diodes 4 of the upper and lower regions and the light guide plate 5 are housed in a case (not shown), and light from the individual light-emitting diodes 4 is efficiently introduced into the inside of the light guide plate 5 through the corresponding upper or lower surface directly or indirectly via a reflector, while a leakage of light to the outside is minimized. Thus, in the backlight device 2, the light utilization efficiency of each of the light-emitting diodes 4 can be easily improved, so that high brightness of the illumination light can be readily achieved.

As described above, the plurality of light-emitting diodes 4 include the light-emitting diodes 4*w*, 4*r*, and 4*b* for emitting the W, R, and B colors of light, respectively. In the light guide plate 5, the incident W, R, and B colors of light are mixed into white light, and this white light is emitted from the emission surface as illumination light.

Specifically, in the light-emitting diodes 4, the white light-emitting diodes 4*w* and the red or blue light-emitting diodes 4*r*, 4*b* are alternately arranged to face the incident surfaces of the light guide plate 5, as shown in FIG. 1. That is, in the backlight device 2 of this embodiment, the white, red, and blue light-emitting diodes 4*w*, 4*r*, and 4*b* are sequentially arranged in a WRWB pattern so as to easily mix the respective colors of light from the light-emitting diodes 4*w*, 4*r*, and 4*b* into white illumination light. Therefore, in the backlight device 2, the luminous quality of the illumination light can be improved, and the illumination light suitable for a full-color image is allowed to enter the liquid crystal panel 3, thus easily improving the display quality of the liquid crystal panel 3.

Besides the above explanation, the light-emitting diodes 4*w*, 4*r*, and 4*b* may be sequentially arranged, e.g., in a WRB pattern. Moreover, the light-emitting diodes 4*w*, 4*r*, and 4*b* also may be arranged to face one side or three or four sides of the light guide plate 5.

In the plurality of light-emitting diodes 4, the number, type, size, etc. of the W, R, and B light-emitting diodes 4*w*, 4*r*, and 4*b* are selected in accordance with the size of the liquid crystal panel 3 and the display performance such as brightness or display quality required for the liquid crystal panel 3. Specifically, e.g., a power LED with a power consumption of about 1 W or a chip LED with a power consumption of about 70 mW is suitably used as each of the light-emitting diodes 4.

Hereinafter, the lighting drive circuit 11 will be described in detail with reference to FIG. 3 as well as FIGS. 1 and 2.

Figure 3:
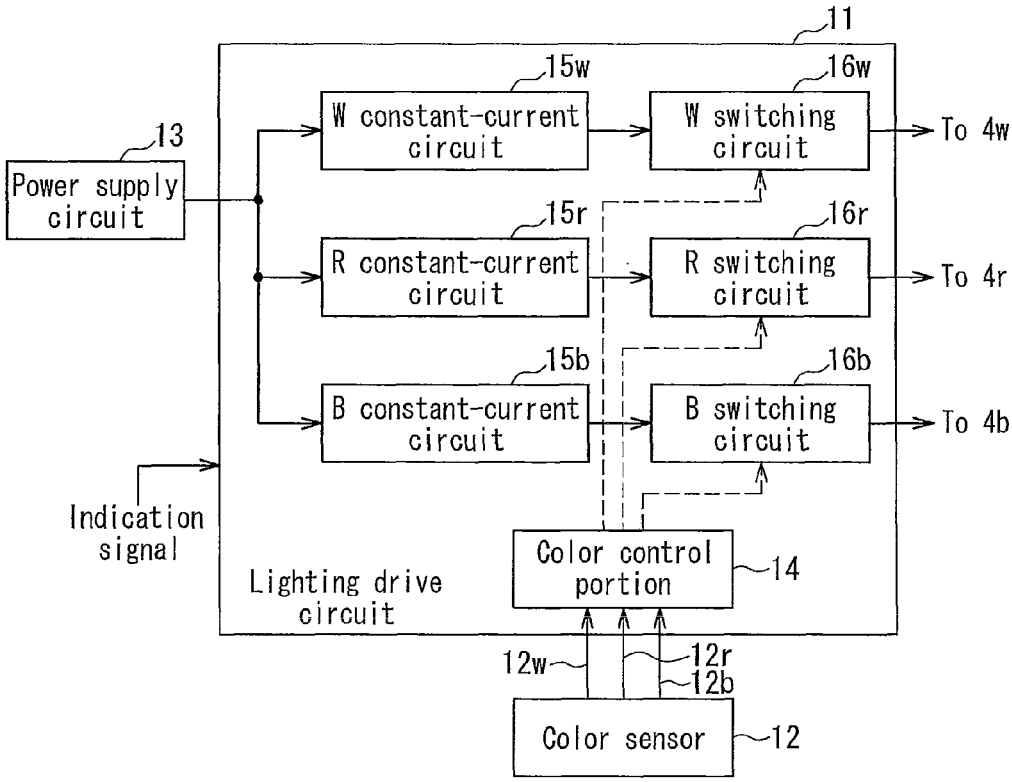
FIG. 3 is a block diagram showing a specific example of the configuration of the lighting drive circuit shown in FIG. 2.

FIG. 3 is a block diagram showing a specific example of the configuration of the lighting drive circuit shown in FIG. 2.

In FIG. 3, the lighting drive circuit 11 includes a color control portion 14 for receiving the detection results of the color sensor 12 that detects the illumination light and a W constant-current circuit 15*w*, an R constant-current circuit 15*r*, and a B constant-current circuit 15*b* to which electric power is supplied from a power supply circuit 13. The lighting drive circuit 11 also includes a W switching circuit 16*w*, an R switching circuit 16*r*, and a B switching circuit 16*b* that are connected to the W constant-current circuit 15*w*, the R constant-current circuit 15*r*, and the B constant-current circuit 15*b*, respectively. Each of the W constant-current circuit 15*w*, the R constant-current circuit 15*r*, and the B constant-current circuit 15*b* feeds a constant current to the corresponding W switching circuit 16*w*, R switching circuit 16*r*, and B switching circuit 16*b*.

The lighting drive circuit 11 lights and drives the light-emitting diodes 4*w*, 4*r*, and 4*b* using the PWM dimming for each color of the light-emitting diodes 4*w*, 4*r*, and 4*b*. That is, in the lighting drive circuit 11, the W constant-current circuit 15*w*, the R constant-current circuit 15*r*, the B constant-current circuit 15*b*, the W switching circuit 16*w*, the R switching circuit 16*r*, and the B switching circuit 16*b* constitute a driving circuit portion that lights and drives the light-emitting diodes 4*w*, 4*r*, and 4*b* by the PWM dimming.

The lighting drive circuit 11 is configured so as to be capable of properly changing the brightness and chromaticity of the illumination light in accordance with the user's instructions. Moreover, the lighting drive circuit 11 changes the amount of light of each of the light-emitting diodes 4*w*, 4*r*, and 4*b* by feedback control using the detection results of the color sensor 12.

Specifically, the color sensor 12 is a light-receiving element that can detect the brightness of white light, red light, and blue light separately, and detects the brightness of each of the white light, the red light, and the blue light contained in the illumination light. Moreover, the color sensor 12 is configured so as to output detection signals 12*w*, 12*r*, and 12*b* indicating the brightness of the white light, the red light, and the blue light, respectively, to the color control portion 14 at predetermined time intervals.

The color control portion 14 includes an arithmetic section such as a CPU or MPU, and a user inputs indication values of the desired chromaticity (i.e. the degree of whiteness) and brightness of the illumination light. Accordingly, the color control portion 14 is configured so as to receive indication signals from a manipulation input device (not shown) such as a remote controller provided, e.g., on the liquid crystal display device 1 side. The indication values of the desired chromaticity and brightness of the illumination light from the user are conveyed through these indication signals. The color control portion 14 can determine a target value of the amount of light of each of the light-emitting diodes 4*w*, 4*r*, and 4*b* based on the indication values of the chromaticity and brightness of the illumination light thus conveyed.

On the other hand, the color control portion 14 receives the detection signals 12*w*, 12*r*, and 12*b* from the color sensor 12, produces PWM dimming signals (as will be described later) for each color of the light-emitting diodes 4*w*, 4*r*, and 4*b* using the detection signals 12*w*, 12*r*, and 12*b* and the above target values, and transmits the PWM dimming signals to the corresponding W switching circuit 16*w*, R switching circuit 16*r*, and B switching circuit 16*b*.

The W switching circuit 16*w* changes the on/off duty ratio of the PWM dimming based on the PWM dimming signal from the color control portion 14. Consequently, the current to be supplied from the W switching circuit 16*w* to the light-emitting diodes 4*w* is changed, and the amount of light of the light-emitting diodes 4*w* is also changed.

Similarly, the R switching circuit 16*r* changes the on/off duty ratio of the PWM dimming based on the PWM dimming signal from the color control portion 14. Consequently, the current to be supplied from the R switching circuit 16*r* to the light-emitting diodes 4*r* is changed, and the amount of light of the light-emitting diodes 4*r* is also changed.

Similarly, the B switching circuit 16*b* changes the on/off duty ratio of the PWM dimming based on the PWM dimming signal from the color control portion 14. Consequently, the current to be supplied from the B switching circuit 16*b* to the light-emitting diodes 4*b* is changed, and the amount of light of the light-emitting diodes 4*b* is also changed.

As described above, the lighting drive circuit 11 performs the feedback control using the detection results of the color sensor 12, so that the brightness and chromaticity of the illumination light can appropriately agree with those desired by the user.

Next, in the backlight device 2 of this embodiment, an adjustment operation for adjusting the chromaticity of the illumination light to a value within a predetermined range of the degree of whiteness, and selection criteria of the white light-emitting diodes 4*w* will be described in detail with reference to FIG. 4 as well as FIGS. 1 to 3.

Figure 4:
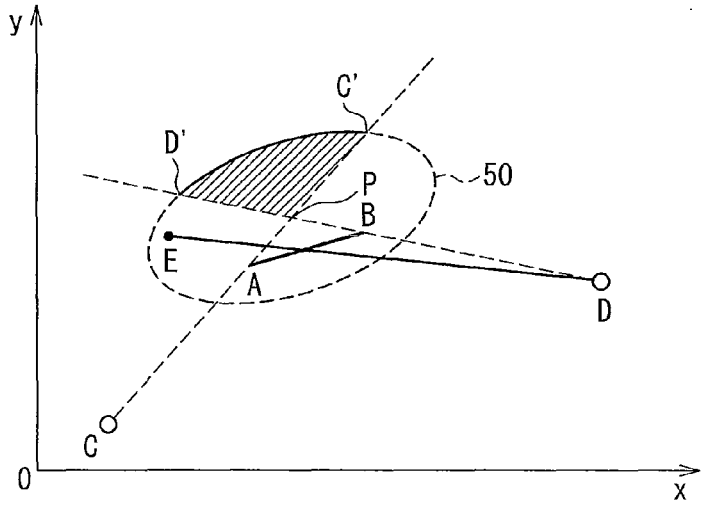
FIG. 4 is a chromaticity diagram showing a color reproduction range in the above backlight device and a diagram for explaining a chromaticity range of the white light-emitting diodes used in this backlight device.

FIG. 4 is a chromaticity diagram showing a color reproduction range in the above backlight device and a diagram for explaining a chromaticity range of the white light-emitting diodes used in this backlight device. The chromaticity diagram in FIG. 4 is a chromaticity diagram (NTSC ratio) showing a color reproduction range in the CIE1931 colorimetric system.

First, the adjustment operation of the backlight device 2 will be described. Referring to FIG. 4, in the backlight device 2 of this embodiment, the chromaticity of the illumination light is adjustable to a value within a predetermined range of the degree of whiteness, e.g., to a chromaticity value in a segment AB joining two points A and B in FIG. 4. That is, the lighting drive circuit 11 allows the illumination light to be of any chromaticity in the segment AB by controlling the amount of light of each of the light-emitting diodes 4*w*, 4*r*, and 4*b*.

More specifically, e.g., in the case where the chromaticity of the illumination light is at the point A, when an indication signal for changing the chromaticity to the point B is input to the lighting drive circuit 11, the color control portion 14 of the lighting drive circuit 11 calculates the amount of light of each of the light-emitting diodes 4*w*, 4*r*, and 4*b* to obtain the chromaticity at the point B. Then, the color control portion 14 produces PWM dimming signals for each of the W, R, and B colors based on the calculated amounts of light, and transmits the PWM dimming signals to the corresponding W switching circuit 16*w*, R switching circuit 16*r*, and B switching circuit 16*b*. Consequently, in the light-emitting diodes 4, e.g., the amount of blue light from the light-emitting diodes 4*b* is reduced while the amount of red light from the light-emitting diodes 4*r* is increased, and thus the chromaticity of the illumination light is adjusted to the chromaticity at the point B.

Next, the selection criteria of the white light-emitting diodes 4*w* in the backlight device 2 of this embodiment will be described. In the following explanation, the backlight device 2 is configured so that the chromaticity of the illumination light is adjustable to a chromaticity value in the segment AB.

In FIG. 4, the chromaticity of blue light emitted from the blue light-emitting diodes 4*b* is represented by a point C, and the chromaticity of red light emitted from the red light-emitting diodes 4*r* is represented by a point D. In these light-emitting diodes 4*b* and 4*r*, as well known, the dominant wavelengths are in the range of 450 to 465 nm and in the range of 620 to 640 nm, respectively. The light-emitting diodes 4*b* and 4*r* have relatively small variations in their emission characteristics. Therefore, in the light-emitting diodes 4*b* and 4*r*, the chromaticity of the blue light and the chromaticity of the red light can be substantially fixed at the points C and D, respectively.

The (x, y) coordinates of the specific chromaticity at each of the points A to D are shown in Table 1. The chromaticities at the points A and B correspond to color temperatures of 9300 K and 5000 K, respectively. The chromaticities at the points C and D are the actually measured values of backlight emission light (i.e., the illumination light) when the corresponding light-emitting diodes 4*b* and 4*r* are incorporated into the backlight device 2.

TABLE 1

| | Chromaticity x | Chromaticity y |
|---|---|---|
| Point A | 0.2836 | 0.2973 |
| Point B | 0.3454 | 0.3602 |
| Point C | 0.1514 | 0.0366 |
| Point D | 0.6896 | 0.3083 |

On the contrary, the white light-emitting diodes 4*w* involve not only product variations of the light-emitting diodes (semiconductors) themselves, but also product variations of the phosphors used in these light-emitting diodes 4*w*. Therefore, as indicated by an ellipse 50 in FIG. 4, the product variations of the light-emitting diodes 4*w* are much larger than those of the light-emitting diodes 4*b* and 4*r*. Thus, the chromaticity of luminous color (white light) varies significantly from product to product. The ellipse 50 is a specific example showing the product variations of the light-emitting diodes 4*w* and is based on the actually measured values of a plurality of light-emitting diodes 4*w*.

In the backlight device 2 of this embodiment, to make the chromaticity of the illumination light adjustable to any chromaticity in the segment AB (i.e., in the predetermined range of the degree of whiteness), a tolerance of the degree of whiteness that indicates selectable light-emitting diodes as the white light-emitting diodes 4*w* is determined using the chromaticities (at the points C and D) of blue light and red light from the light-emitting diodes 4*b* and 4*r* and the predetermined range of the degree of whiteness (i.e., the chromaticities at the points of A and B).

Specifically, the (x, y) coordinates of the chromaticity at an intersection point C' of the ellipse 50 and the extension line of a segment CA joining the points C and A are determined. Similarly, the (x, y) coordinates of the chromaticity at an intersection point D' of the ellipse 50 and the extension line of a segment DB joining the points D and B are determined. Moreover, the (x, y) coordinates of the chromaticity at an intersection point P of the extension line of the segment CA and the extension line of the segment DB are determined. Then, the diagonally shaded area in FIG. 4 is defined as the tolerance of the degree of whiteness. The white light-emitting diodes 4*w* in which the chromaticity of the luminous color is within the tolerance of the degree of whiteness are selected and used. Thus, the chromaticity of the illumination light can be adjusted to any chromaticity in the segment AB by controlling the amount of light of each of the light-emitting diodes 4*w*, 4*r*, and 4*b*.

In contrast, when white light-emitting diodes that are out of the tolerance of the degree of whiteness, e.g., white light-emitting diodes having a chromaticity represented by a point E in FIG. 4 are selected, no matter how large the amount of light of the red light-emitting diodes 4*r* is, the chromaticity (i.e., the degree of whiteness) of the illumination light cannot be adjusted to a chromaticity value that lies on the point B side of the segment AB with respect to an intersection point of the segment AB and a segment DE joining the points D and E.

As described above, in the backlight device 2 of this embodiment, the white light-emitting diodes 4*w* in which the chromaticity of the luminous color is within the tolerance of the degree of whiteness are selected, and thus the chromaticity of the illumination light can be flexibly adjusted to a value within the predetermined range of the degree of whiteness.

The backlight device 2 with the above configuration of this embodiment includes the white light-emitting diodes 4*w*, the red and blue light-emitting diodes 4*r* and 4*b*, and the lighting drive circuit (lighting control portion) 11 for controlling the lighting/driving of each of the light-emitting diodes 4*w*, 4*r*, and 4*b*. Accordingly, unlike the conventional examples, the backlight device 2 of this embodiment can properly control the brightness and chromaticity of the illumination light even if the number of light-emitting diodes 4 placed is to be reduced. Therefore, a low-cost low-power backlight device 2 can be achieved. Consequently, in this embodiment, a low-cost low-power liquid crystal display device 1 with excellent display performance can be easily achieved even if the brightness and screen size of the liquid crystal panel (display portion) 3 are to be increased.

Specifically, comparing a product of this embodiment with a conventional product, the present inventors produced backlight devices using power LEDs with a power consumption of about 1 W for a 23-inch diagonal liquid crystal display device. In the case of the conventional product (corresponding to the above first conventional example) that used three types of R, G, and B light-emitting diodes, 47 red light-emitting diodes, 68 green light-emitting diodes, and 37 blue light-emitting diodes were needed to control the brightness of the illumination light to, e.g., 600 (cd/m$^2$). That is, the conventional product required a total of 152 light-emitting diodes, and the power consumption was 130 W.

On the other hand, the product of this embodiment was able to have a brightness of 600 (cd/m$^2$) only by using 63 white light-emitting diodes, 48 red light-emitting diodes, and 20 blue light-emitting diodes. The simulation conducted by the present inventors showed that the product of this embodiment had the same brightness as that of the conventional product with a total of 131 light-emitting diodes, which was about 14% smaller than the number of light-emitting diodes placed in the conventional product. The simulation also showed that due to a reduction in the number of light-emitting diodes placed, the product of this embodiment was able to reduce the cost compared to the conventional product, and the power consumption was 96 W, which was about 26% smaller than that of the conventional product.

In the backlight device 2 of this embodiment, the lighting drive circuit 11 controls the amount of light of each of the light-emitting diodes 4*w*, 4*r*, and 4*b*, thereby adjusting the chromaticity of the illumination light to a value within the predetermined range of the degree of whiteness as indicated by the segment AB in FIG. 4. Thus, the backlight device 2 of this embodiment can control the degree of whiteness of the illumination light with high precision. Moreover, since the degree of whiteness of the illumination light can be controlled with high precision, this embodiment can easily provide the backlight device 2 suitable for a monochrome liquid crystal display device even if the number of light-emitting diodes 4 placed is reduced.

The monochrome liquid crystal display device is used for medical purposes such as MRI or X ray radiograph analysis or design purposes such as CG (computer graphics). Therefore, the monochrome liquid crystal display device is required to finely adjust the chromaticity of white light as illumination light. The backlight device 2 of this embodiment can adequately meet the above requirement of the monochrome liquid crystal display device by properly controlling the chromaticity of white light (i.e., the degree of whiteness of the illumination light) even if the number of light-emitting diodes 4 placed is reduced.

Moreover, the backlight device 2 of this embodiment uses the white light-emitting diodes 4*w* that fall within the tolerance of the degree of whiteness as indicated by the diagonally shaded area in FIG. 4. Thus, suitable light-emitting diodes are selected as the white light-emitting diodes 4*w* that have relatively large variations in their emission performance. Consequently, in the backlight device 2 of this embodiment, the degree of whiteness of the illumination light can be more easily controlled, and the backlight device 2 suitable for the monochrome liquid crystal display device can be more easily provided.

In the backlight device 2 of this embodiment, the lighting drive circuit 11 performs the feedback control of the amount of light of each of the light-emitting diodes 4*w*, 4*r*, and 4*b* using the detection results of the color sensor 12. Therefore, the brightness and chromaticity of the illumination light can be more properly controlled. Thus, the liquid crystal display device 1 with excellent display performance can be easily achieved.

In the backlight device 2 of this embodiment, even when the luminous efficiency of each of the light-emitting diodes 4*w*, 4*r*, and 4*b* is changed due to ambient temperature fluctuations or variations with time, and thus the spectra of the corresponding colors of light are also changed, the lighting drive circuit 11 can quickly correct such spectrum changes by performing the feedback control using the detection results of the color sensor 12, as described above. Consequently, the backlight device 2 of this embodiment can emit the illumination light with desired brightness and chromaticity while eliminating the adverse effects such as ambient temperature fluctuations or the like. Therefore, a high-performance liquid crystal display device 1 can be achieved.

Embodiment 2

Figure 5:
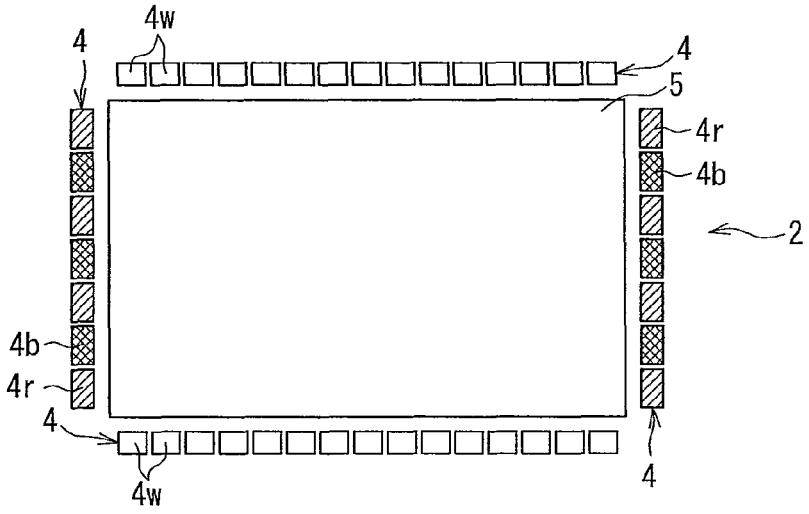
FIG. 5 is a plan view showing the configuration of a main portion of a backlight device according to Embodiment 2 of the present invention.

FIG. 5 is a plan view showing the configuration of a main portion of a backlight device according to Embodiment 2 of the present invention. In FIG. 5, this embodiment differs from Embodiment 1 mainly in that the white light-emitting diodes are located opposite to each other with respect to two opposing surfaces of four surfaces of the light guide plate, and the red and blue light-emitting diodes are located opposite to each other with respect to the remaining two opposing surfaces. The same components as those in Embodiment 1 are denoted by the same reference numerals, and the explanation will not be repeated.

As shown in FIG. 5, in the backlight device 2 of this embodiment, a plurality of light-emitting diodes 4 are arranged so as to surround the light guide plate 5, and light from the individual light-emitting diodes 4 is introduced into the inside of the light guide plate 5 through four surfaces, i.e., two pairs of opposing surfaces (incident surfaces) of the light guide plate 5.

As shown in FIG. 5, in the backlight device 2 of this embodiment, the white light-emitting diodes 4*w* are located opposite to each other with respect to the upper surface and the lower surface of the light guide plate 5. Moreover, the red and blue light-emitting diodes 4*r* and 4*b* are alternately arranged and located opposite to each other with respect to the left surface and the right surface of the light guide plate 5.

With the above configuration, the backlight device 2 of this embodiment can have similar effects to those of Embodiment 1. Moreover, in the backlight device 2 of this embodiment, the light-emitting diodes 4 are arranged to face the four surfaces of the light guide plate 5, which results in a sidelight type backlight device with higher brightness compared to Embodiment 1.

Embodiment 3

Figure 6:
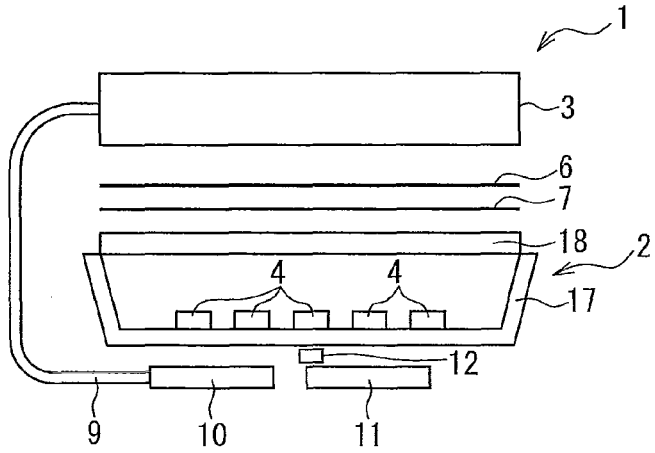
FIG. 6 is a diagram for explaining a backlight device and a liquid crystal display device according to Embodiment 3 of the present invention.
Figure 7:
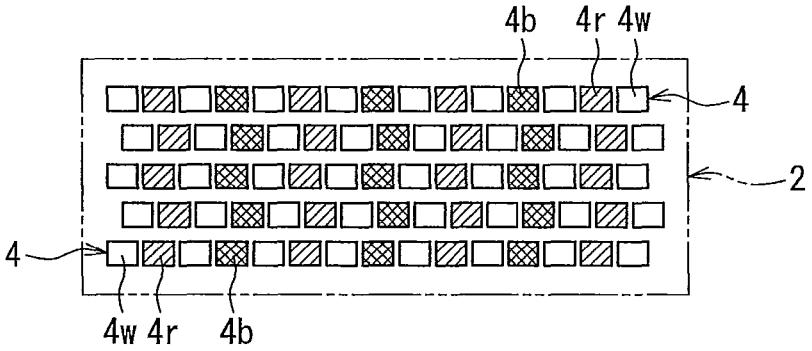
FIG. 7 is a plan view showing a specific example of the arrangement of light-emitting diodes in the backlight device shown in FIG. 6.

FIG. 6 is a diagram for explaining a backlight device and a liquid crystal display device according to Embodiment 3 of the present invention. FIG. 7 is a plan view showing a specific example of the arrangement of light-emitting diodes in the backlight device shone in FIG. 6. In FIGS. 6 and 7, this embodiment differs from Embodiment 1 mainly in that a direct type backlight device is configured by locating a plurality of light-emitting diodes on the underside of the liquid crystal panel. The same components as those in Embodiment 1 are denoted by the same reference numerals, and the explanation will not be repeated.

In the backlight device 2 of this embodiment, as shown in FIG. 6, the plurality of light-emitting diodes 4 are housed inside a bottomed case 17 whose upper end is open. A diffusing plate 18 is located on the opening side of the case 17 so as to cover the opening instead of the diffusing sheet 8. The backlight device 2 directs light from the light-emitting diodes 4 toward the liquid crystal panel 3 that is located above the diffusing plate 18.

In the backlight device 2 of this embodiment, as shown in FIG. 7, the W, R, and B light-emitting diodes 4*w*, 4*r*, and 4*b* are arranged in a row in a WRWB pattern on the bottom of the casing 17 (FIG. 6), and a total of five rows of the light-emitting diodes is provided.

With this configuration, the backlight device 2 of this embodiment can have similar effects to those of Embodiment 1. Moreover, in the backlight device 2 of this embodiment, the plurality of light-emitting diodes 4 are located on the underside of the liquid crystal panel 3, which results in a direct type backlight device 2 that can properly control the brightness and chromaticity of the illumination light even if the number of light-emitting diodes 4 placed is to be reduced.

It should be noted that the above embodiments are all illustrative and not restrictive. The technological scope of the present invention is defined by the appended claims, and all changes that come within the range of equivalency of the claims are intended to be embraced therein.

For example, although the above description has been directed to the case of applying the present invention to a transmission type liquid crystal display device, the backlight device of the present invention is not limited to this. The present invention can be applied to various display devices including a non-luminous display portion that utilizes light from a light source to display information such as an image and a character. Specifically, the backlight device of the present invention can be used in a semi-transmission type liquid crystal display device or a projection display device such as a rear projection in a preferred manner.

Moreover, besides the above description, the present invention can be used in a preferred manner as a backlight device in a film viewer for irradiating light to a roentgenograph, a light box for irradiating light to a negative for better viewability or a light emitting device for illuminating a signboard or an advertisement or the like installed on a wall surface on a station premise.

In the above description, the white light-emitting diodes and the red and blue light-emitting diodes are used. However, the present invention is not limited to this, and may use white light-emitting diodes and two types of light-emitting diodes selected from three types of red, green, and blue light-emitting diodes for emitting red light, green light, and blue light, respectively.

As described in each of the above embodiments, it is preferable to use the red and blue light-emitting diodes because the degree of whiteness of the illumination light can be easily controlled compared to the use of the green light-emitting diodes.

Moreover, the effects of reducing the number of LEDs and the power consumption are larger in the configuration using white, red, and blue light-emitting diodes than in the configuration using white, green, and blue light-emitting diodes or the configuration using white, red, and green light-emitting diodes. The reason for this is as follows. Both the white and green light-emitting diodes have emission spectrum peaks that are close to the peak of a luminosity curve of human beings. Therefore, in the configuration using white, red, and blue light-emitting diodes, it is easy to replace the green light-emitting diodes with the white light-emitting diodes, and further the white light-emitting diodes are superior in luminous efficiency to each of the R, G, and B light-emitting diodes.

In the above description, the red light-emitting diodes having a dominant wavelength of 620 to 640 nm are used. However, the present invention is not limited to this, and may use light-emitting diodes that have a dominant wavelength of 580 nm or more and emit orange luminous color as the red light-emitting diodes. That is, the present invention can use light-emitting diodes having a dominant wavelength of 580 nm to 640 nm as the red light-emitting diodes. When the light-emitting diodes for emitting orange luminous color are used as the red light-emitting diodes, the degree of freedom in the design of the backlight device can be increased.

In the above description, the lighting control portion includes the driving circuit portion that lights and drives the light-emitting diodes by PWM dimming. However, the present invention is not limited to this. For example, current dimming may be used to light and drive the light-emitting diodes.

As described in each of the above embodiments, however, the PWM dimming is preferred to the current dimming that changes the current value with the amount of light to be emitted, since the amount of light of each of the light-emitting diodes can be suitably changed without modifying the spectrum of light from the corresponding light-emitting diodes, and thus the chromaticity of the illumination light can be more easily controlled.

INDUSTRIAL APPLICABILITY

The backlight device of the present invention and the display device using the same can properly control the brightness and chromaticity of illumination light even if the number of light-emitting diodes placed is to be reduced. Therefore, the present invention is useful for a display device that includes a low-cost laborsaving backlight device capable of irradiating a display portion having a large screen with high-brightness illumination light, and the display portion.

The invention claimed is:

1. A backlight device for emitting illumination light outward, comprising:

white light-emitting diodes for emitting white light, the white light-emitting diodes having chromaticity within a first chromaticity region of a color space;

two types of light-emitting diodes selected from three types of red, green, and blue light-emitting diodes for emitting red light, green light, and blue light, respectively; and a lighting control portion for controlling lighting/driving of each of the white light-emitting diodes and the two types of light-emitting diodes to produce the illumination light of the backlight device of chromaticity in a second chromaticity region of the color space, the second chromaticity region defined as a line connecting a first chromaticity point and a second chromaticity point, wherein the first chromaticity region of the color space is outside of the second chromaticity region and is bounded by a partial arc of an ellipse, a line passing through the first chromaticity point and a chromaticity point of the first type of the two types of light-emitting diodes, and a line passing through the second chromaticity point and a chromaticity point of the second type of the two types of light-emitting diodes.

2. The backlight device according to claim 1, wherein the lighting control portion adjusts the chromaticity of the illumination light to a value within a predetermined range of a degree of whiteness by controlling an amount of light of said each of the white light-emitting diodes and the two types of light-emitting diodes.

3. The backlight device according to claim 2, wherein the light-emitting diodes that emit the white light that is within a tolerance of the degree of whiteness are selected as the white light-emitting diodes, and the tolerance of the degree of whiteness is determined using chromaticity of light from said each of the two types of light-emitting diodes and the predetermined range of the degree of whiteness.

4. The backlight device according to one of claims 2 and 3, wherein the two types of light-emitting diodes are the red light-emitting diodes and the blue light-emitting diodes.

5. The backlight device according to claim 1, wherein the light-emitting diodes having a dominant wavelength of 580 nm to 640 nm are used as the red light-emitting diodes.

6. The backlight device according to claim 1, further comprising a light guide plate with an incident surface through which light from the white light-emitting diodes and the two types of light-emitting diodes is introduced, wherein the white light-emitting diodes and the two types of light-emitting diodes are alternately arranged to face the incident surface.

7. The backlight device according to claim 1, further comprising a light guide plate with an incident surface through which light from the white light-emitting diodes and the two types of light-emitting diodes is introduced, wherein two opposing surfaces of four surfaces of the light guide plate serve as incident surfaces through which light from the white light-emitting diodes and one of the two types of light-emitting diodes is introduced, and the remaining two opposing surfaces serve as incident surfaces through which light from the white light-emitting diodes and the other of the two types of light-emitting diodes is introduced.

8. The backlight device according to claim 1, wherein light-emitting portions of the white light-emitting diodes and the two types of light-emitting diodes are located on a straight line with respect to an object to be irradiated.

9. The backlight device according to claim 1, wherein the lighting control portion comprises a driving circuit portion that lights and drives the white light-emitting diodes and the two types of light-emitting diodes by PWM dimming.

10. The backlight device according to claim 6, further comprising:

a color sensor for detecting the illumination light, wherein the light guide plate includes a first surface facing toward a liquid crystal panel, and a second surface facing opposite of the first surface, the color sensor has a position adjacent to the second surface, and the lighting control portion controls the amount of light of said each of the white light-emitting diodes and the two types of light-emitting diodes using detection results of the color sensor.

11. A display device comprising a display portion, wherein the display portion is irradiated with the illumination light from the backlight device according to claim 1.

12. The backlight device according to claim 6, wherein a pattern of the white light-emitting diode, the first type of light-emitting diode, the white light-emitting diode, and the second type of light-emitting diode is repeated along the incident surface of the light guide plate.

* * * * *